United States Patent [19]

Langenberg

[11] Patent Number: 4,843,989

[45] Date of Patent: Jul. 4, 1989

[54] SHIP'S HULL FOR SMALL VESSELS AND HIGH SPEEDS

[75] Inventor: Hans Langenberg, Sprützmoor, Fed. Rep. of Germany

[73] Assignee: Blohm & Voss AG, Hamburg, Fed. Rep. of Germany

[21] Appl. No.: 121,312

[22] Filed: Nov. 16, 1987

[30] Foreign Application Priority Data

Nov. 15, 1986 [DE] Fed. Rep. of Germany ..... 3639175

[51] Int. Cl.[4] ..... B63B 1/04; B63B 1/06; B63B 1/08

[52] U.S. Cl. ..... 114/56; 114/57

[58] Field of Search ..... 114/56, 57, 140, 271

[56] References Cited

U.S. PATENT DOCUMENTS

| | | | |
|---|---|---|---|
| 1,294,082 | 2/1919 | Golden | 114/57 |
| 2,361,409 | 10/1944 | Munro | 114/56 |
| 3,138,130 | 6/1964 | Morgan | 114/57 |
| 3,924,557 | 12/1975 | Bloch | 115/38 |
| 3,937,173 | 2/1976 | Stuart | 115/39 |
| 4,010,707 | 3/1977 | Bendall | 115/12 R |
| 4,300,889 | 11/1981 | Wormser | 440/69 |
| 4,383,828 | 5/1983 | Wynne | 440/69 |
| 4,428,734 | 1/1984 | Ludlow | 440/75 |
| 4,459,116 | 7/1984 | Moore | 440/31 |
| 4,609,360 | 9/1986 | Whitehead | 440/69 |

FOREIGN PATENT DOCUMENTS

| | | | |
|---|---|---|---|
| 912243 | 1/1938 | Sweden | 114/57 |

*Primary Examiner*—Sherman D. Basinger
*Attorney, Agent, or Firm*—Nils H. Ljungman

[57] ABSTRACT

Ship's hull, characterized by the fact that the hull below the construction water line (C.W.L.) consists of a bulb-shaped displacement body extending approximately over the entire length of the ship, which is slim in the forebody, then becomes uniformly thicker toward the stern over approximately $\frac{2}{3}$ of the ship's length, and then tapers toward a large central propeller (P), and on top of which there is a vessel with lines in the nature of the V-shaped frame, which makes a transition toward the stern into a tunnel, which covers the bulb-shaped body and propeller so that above the bulb, there is a sharply concave, trough-shaped form.

15 Claims, 5 Drawing Sheets

SHIP'S HULL FOR SMALL VESSELS AND HIGH SPEEDS

BACKGROUND OF THE INVENTION

1. Field of the Invention

This invention relates to a ship's hull for small vessels and high speeds with static and dynamic buoyancy.

2. Description of the Prior Art

Small, fast ships, in particular motorboats and military vessels, are predominantly designed as dual-screw (or dual propeller) vessels, because with two or four screws, the propeller's tendency toward cavitation is reduced, and hydrodynamic nonuniformity of the drive can be prevented.

The prior art includes the following solutions to prevent cavitation:

1. The production of a uniform slipstream field in the axial, radial and tangential direction;

2. The prevention of a diagonal flow;

3. The choice of a large propeller diameter and/or a high surface ratio; and

4. The distribution of the power to two propellers located one behind the other (contra-rotating propellers).

In addition, the prior art does not include suitably high-powered drive equipment.

Finally, even today, the argument is used that with dualscrew (or dual propeller) vessels, the vessel can still be operated even if one drive engine fails, and that the dual-screw drive allows improved maneuvering characteristics.

In commercial shipping, multi-screw drives have been almost completely abandoned in the last ten to fifteen years, because a single-screw drive reduces the investment cost by approximately 10 percent and the fuel costs by approximately 15 percent. In addition, the control characteristics of the vessel are significantly better during slow-speed travel than with dual-screw vessels, if the latter are equipped with a central rudder.

Examples of prior art which relate to ships or vessels employing propeller propulsion, and the technical concerns relating thereto, are: U.S. Pat. No. 4,383,828, entitled "Power Boat with Extended Propeller Pocket"; U.S. Pat. No. 4,459,116, entitled "Screw Propelled Water Saddle"; U.S. Pat. No. 4,010,707, entitled "Marine Propulsion Unit"; U.S. Pat. No. 4,428,734, entitled "Planing-Hull Type Boats and Power Drives Therein"; U.S. Pat. No. 3,937,173 entitled "Deep-V Tunnel Stern Boat"; U.S. Pat. No. 3,924,557, entitled "Propeller Mechanism for Boats"; U.S. Pat. No. 4,609,360, entitled "Boat Hull with Flow Chamber"; and U.S. Pat. No. 4,300,889, entitled "Shallow Draft Propeller Pocket".

All of the aforementioned prior art documents relating to propeller driven ships or vessels are hereby expressly incorporated by reference, with the same effect as if set forth in their entireties herein.

OBJECT OF THE INVENTION

The object of the invention is, therefore, the replacement of the dual-screw drive by a single-screw drive for fast, small ships, in particular, for motorboats and military vessels. It presupposes the elimination of undesirable cavitation and the resulting noises and vibrations.

SUMMARY OF THE INVENTION

The solution proposed by the invention is described in the claims. The following are the advantages and improvements achieved by the invention, in particular, for fast boats:

1. A reduction of the hull resistance on account of a movement of the displacement center of gravity inward, i.e., by providing a small entry angle in the forebody;

2. Elimination of the resistance caused by the bearings of the lateral propeller shafts (10–15 percent of the total resistance);

3. An improvement of the ship's propeller performance factor by utilizing the displacement downwash (5–10 percent);

4. A recovery of the energy of rotation from the wake of the first propeller through the use of a CR (or contra-rotating) propeller (5–10 percent).

These improvements produce, among other things, an increase in the range (radius of action) and/or the loading capacity for loose equipment, or a decrease in size of the ship.

In general, the invention features a hull of a ship having a central propeller, the ship's hull comprising: a bulb shaped displacement body extending over approximately the longitudinal length of the ship, the displacement body being narrowly tapered in its forward portion proximate the bow of the ship. The displacement body becomes uniformly wider as it extends towards the stern of the ship until the displacement body reaches a point proximate approximately two-thirds the distance from the bow to the stern. The displacement body, after approximately the two-thirds point, becomes narrowingly tapering inward towards the central propeller. The displacement body is provided with at least one inwardly concave depression proximate and above the central propeller.

The accompanying FIGS. 1–7 show side views and plan views of a motor boat designed according to the invention.

DESCRIPTION OF THE PREFERRED EMBODIMENTS

Figure 1:
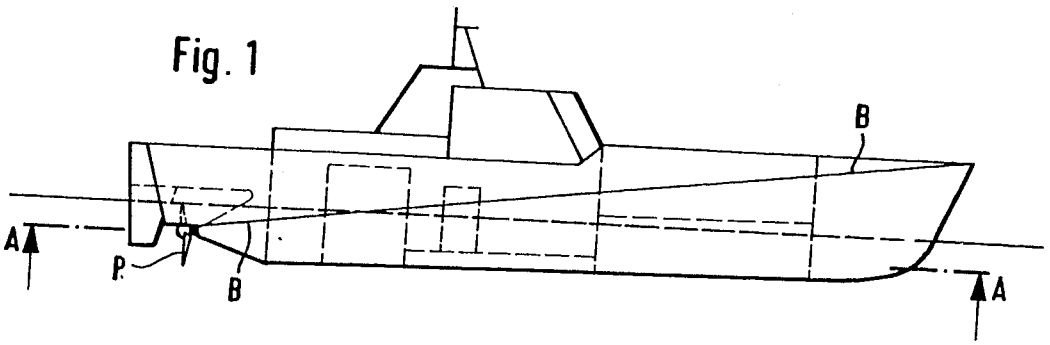
FIG. 1 shows a side view of a ship designed according to the invention, with the body plan shown in FIG. 4.

FIG. 1 shows a small, fast ship constructed according to the present invention in that the hull of the ship, which as is generally shown in FIG. 1, is located beneath a line B sloping from the forward and uppermost prow of the ship downward and rearward to the general vicinity of the ship's propeller P.

Ships which may advantageously employ the present invention will typically be small, fast ships in the general class of 40–50 meters in length, such as patrol-torpedo boats (or "PT boats"). However, it is contemplated that the hull constructed according to the present invention could be employed for larger or smaller ships or vessels.

The ship's hull shown in FIG. 1, and illustrated in greater detail in FIGS. 2–7, may be constructed of any suitable material, such as steel, aluminum, fiberglass, plastic, etc.

Figure 2:
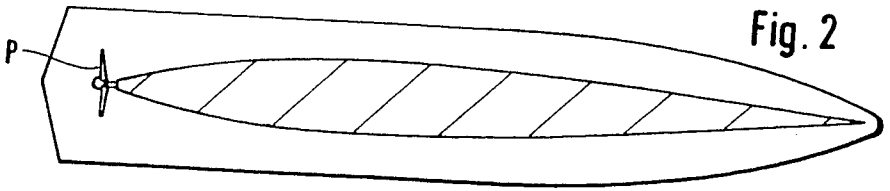
FIG. 2 shows a view from below of the bulb according to the invention, with a horizontal section along Line A—A in FIG. 1.

FIG. 2 is a upwardly looking horizontal sectional view along the lines A—A shown in FIG. 1. As is clearly shown in FIG. 2, the bottom portion of the ship's hull of the present invention, when viewed in a sectional plan view, consists of a bulb shaped displacement body which extends roughly over the entire length of the ship. The displacement body is narrowly tapered towards the bow of the ship and provides a narrow entry angle at its foremost portion. The displacement body then becomes uniformly wider as it proceeds towards the stern of a ship, becoming widest at a position which is approximately two-thirds of the ship's length towads the stern. The displacement body thereafter begins a gradual narrowing taper and terminates proximate a large centrally mounted propeller P.

Figure 3:
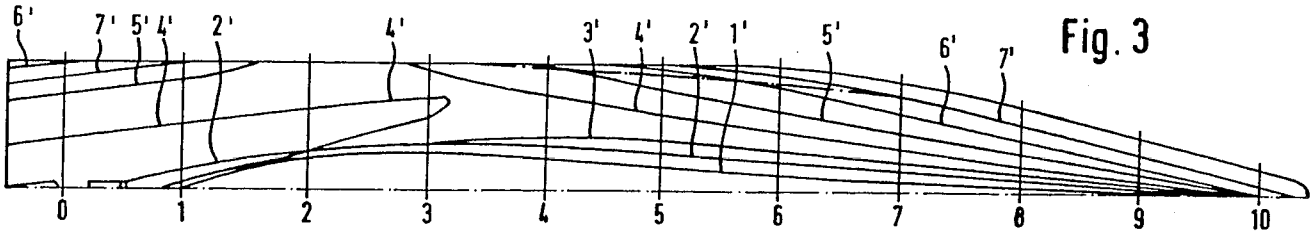
FIGS. 3 and 4 show, respectively, a half water line plan and a body plan of a ship according to the invention.
Figure 4:
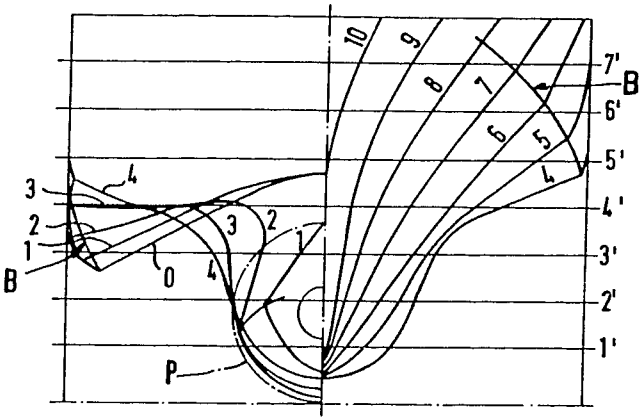

FIGS. 3 and 4 should be viewed in conjunction with one another. In FIG. 3, there is shown a half bottom plan view of the ship's hull, wherein contour lines (i.e., lines of substantially constant relative elevation) 1'–7' are shown, so as to indicate the shaping and configuration of the hull. Additionally, in FIG. 3, longitudinal positions (or stations) 0–10 denote various longitudinal positions along the length of the hull.

Referring now to FIG. 4, it will be seen that the aforementioned relative elevational indicators 1'–7' denote constant heights above the bottommost portion of the ship's hull. Additionally shown in FIG. 4 are a series of ship's hull profiles 1–10 which indicate the vertical profile of the ship's hull at the various longitudinal positions 0–10 shown in FIG. 3. While only half of the ship's hull profile at longitudinal positions 0–10 is shown in FIG. 4, it will be understood by those skilled in the art that the hull is substantially symmetrical with respect to the center line and therefore the half profile not shown will be essentially a mirror image of the half profile indicated.

Still referring to FIG. 4, it will be seen that the displacement body is relatively narrow at its forwardmost position, as shown by half profile 10 in FIG. 4, and as is indicated by the sectional plan view of FIG. 2. Thereafter, and preceding towards the stern, the displacement body gradually tapers outwards, as is shown by the gradually widening half profiles 9–5. Beginning at approximately longitudinal position 4 (which corresponds to approximately two-thirds of the ship's length), the ship's hull profiles begin to assume an inwardly concave curvature, which produces a gradual narrowing of the displacement body from the approximately two-thirds position towards the stern of the ship. This inward concave curvature of the hull is progressively accentuated through longitudinal positions 3, 2 and 1, and results in sharply concave and trough shaped indentations formed just forward and above the propeller P which is located intermediate between longitudinal positions 0 and 1. Finally, at the sternmost longitudinal position 0, the hull is substantially concave upwards.

Also shown in FIG. 4 is a break line B which indicates a sharp angular discontinuity in the otherwise generally smooth curvature of the hull. This break line B is also indicated in FIG. 1.

Figure 5:
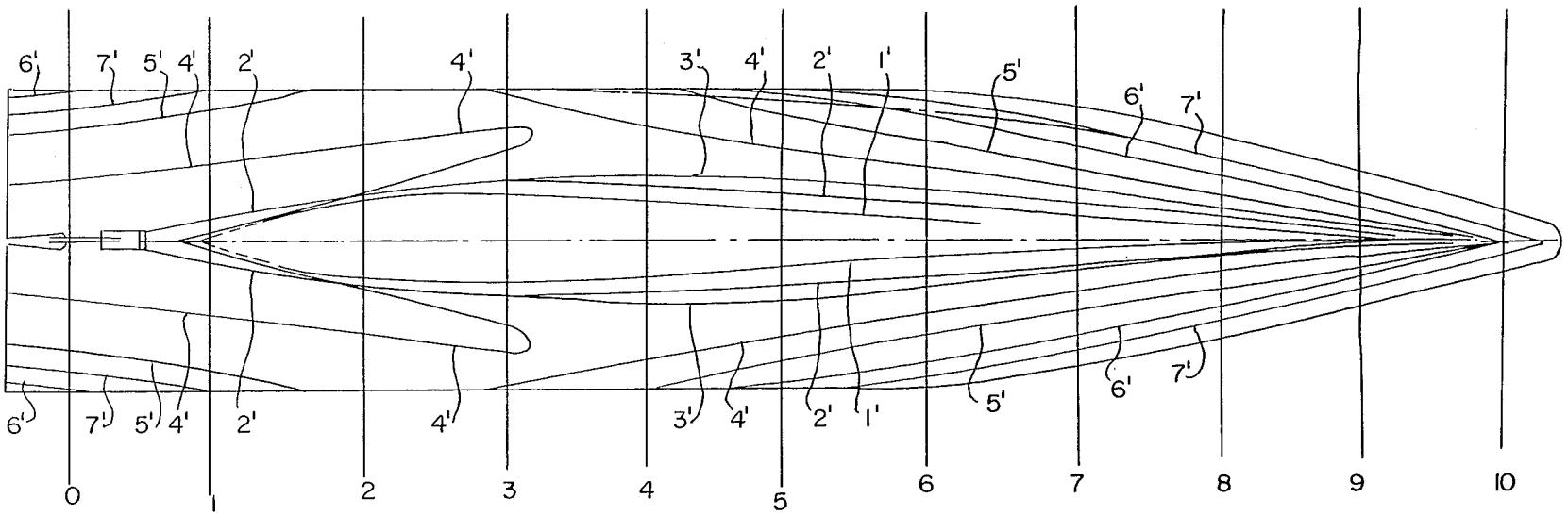
FIG. 5 is an expanded bottom plan view of a ship's hull constructed according to the invention.

FIG. 5 is an expanded bottom plan view of a ship's hull constructed according to the present invention, wherein both sides of the hull have been shown, wherein lines of relatively constant elevation 1'–7' have been indicated and wherein a background grid has been provided for determining relative degrees of curvature of various portions of the hull. For example, the substantially constant elevational line 5' could be determined (or plotted) from the grid background of FIG. 5 as follows:

Considering the intersection of longitudinal position 4 and the centerline of the hull to be the origin, the approximate plotting of the hull would be as follows:

| | | | | | | | |
|---|---|---|---|---|---|---|---|
| x | 0 | 5 | 10 | 15 | 20 | 25 | 30 |
| y | 10.5 | 9.5 | 8.7 | 7.8 | 7.0 | 6.0 | 5.3 |
| x | 35 | 40 | 45 | 50 | 55 | 60 | |
| y | 4.3 | 3.7 | 2.8 | 2.0 | 1.0 | 0 | |

Figure 6:
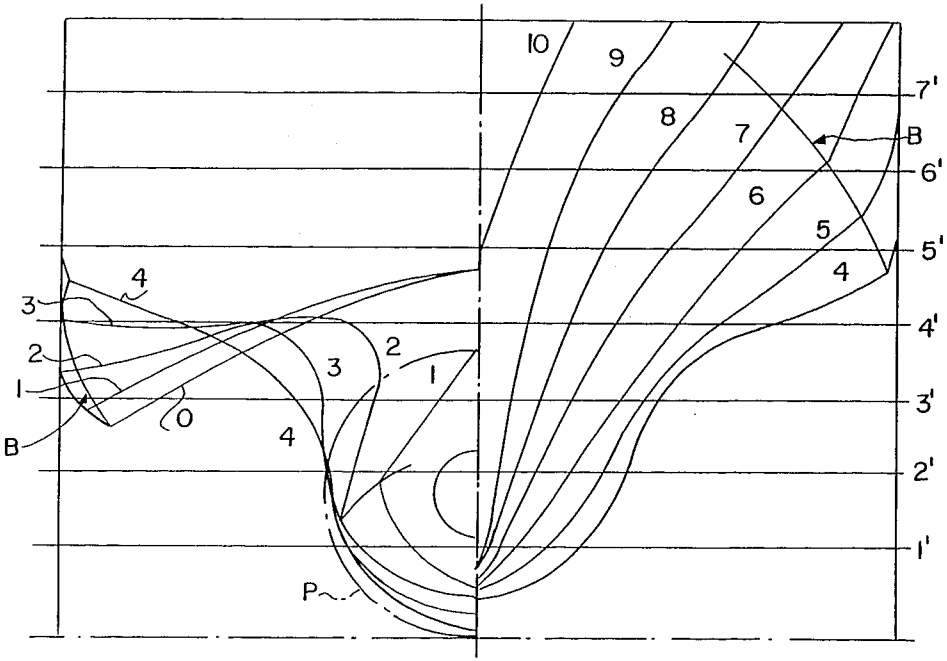
FIG. 6 is an expanded series of profiles of the ship's hull of FIG. 5.
Figure 7:
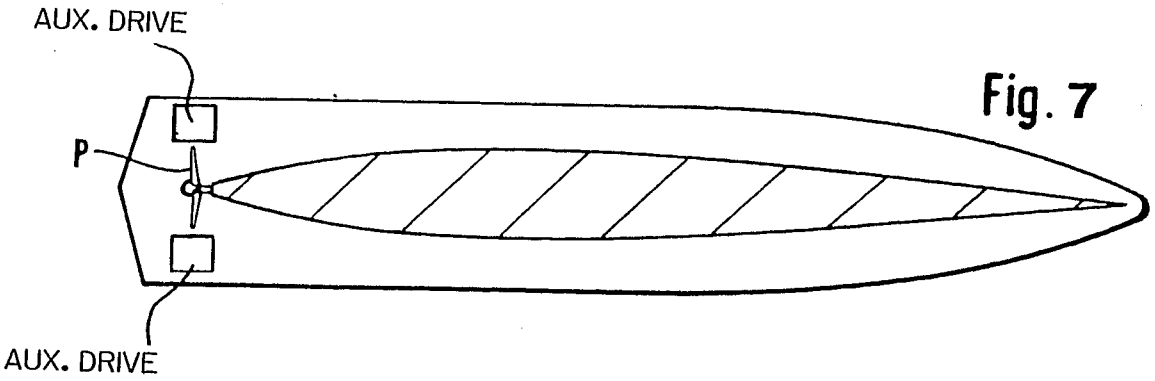
FIG. 7 is a bottom plan sectional view of an alternate embodiment of a ship's hull constructed according to the present invention, wherein auxiliary drives are provided in addition to a central main propeller.

FIG. 6 is an expanded series of half profiles of the ship's hull, provided with a grid background for purposes of determining the relative degrees of curvature of the vertical profile of a ship's hull constructed according to the present invention. For example, the half profile of the ship's hull at longitudinal position 5 could be substantially determined (or plotted) as follows:

Considering the origin as being the intersection of the bottom line and the center line of FIG. 6:

| | | | | | | |
|---|---|---|---|---|---|---|
| x | 0 | 5 | 10 | 15 | 20 | 25 |
| y | 3.3 | 6.7 | 14.6 | 20.3 | 24.3 | 23.8 |

While the above determinations of curvatures have been performed with respect to only one profile provided in each of FIGS. 5 and 6, it will be clear to those of ordinary skill in the art that similar calculations can be carried out with respect to the remaining profiles shown.

As noted above, it is contemplated that the ship's hull of the present invention may be used with a variety of ships and vessels of various sizes. Accordingly, FIGS. 5 and 6 should not be taken to represent one particular scale. Nor should they be taken to necessarily correspond to a common scale. Rather, it will be clear to one skilled in the art that he or she may adapt the relative proportionings shown in FIGS. 5 and 6 so as to equip any one of a number of vessels of various sizes with a hull constructed according to the present invention.

While the invention has been described by way of a particular preferred embodiment, various substitutions of equivalents may be effected without departing from the spirit and scope of the invention as set forth in the following appended claims.

What is claimed is:

1. A hull of a ship having a central propeller, said ship's hull comprising:

a bulb shaped displacement body extending over approximately the longitudinal length of said ship;

said displacement body being narrowly tapered in its forward portion proximate the bow of said ship;

said displacement body becoming uniformly wider as it extends towards the stern of said ship until said displacement body reaches a point proximate approximately two-thirds the distance from said bow to said stern;

said displacement body, after approximately said two-thirds point, becoming narrowingly tapered inward towards said central propeller; and said displacement body being provided with at least one inwardly concave depression proximate and above said central propeller.

2. The hull of a ship according to claim 1, wherein said forward portion of said displacement body proximate the bow of said ship has a substantially V-shaped transverse vertical profile.

3. The hull of a ship according to claim 1, wherein the rearward portion of said displacement body proximate the stern of said ship has a transverse vertical profile which is generally upwardly concave.

4. The hull of a ship according to claim 3, wherein said at least one depression comprises two inwardly concave depressions located symmetrically with respect to said central propeller.

5. The hull of a ship according to claim 2, wherein said at least one depression comprises two inwardly concave depressions located symmetrically with respect to said central propeller.

6. The hull of a ship according to calim 2, wherein the exterior surface of said ship's hull, below water, is a substantially smooth continuous surface.

7. The hull of a ship according to claim 2, further comprising at least a pair of auxiliary drive means for propelling said ship, said at least to auxiliary drive means being located so as to flank said central propeller.

8. The hull of a ship according to claim 1, wherein the rearward portion of said displacement body proximate the stern of said ship has a transverse vertical profile which is generally upwardly concave.

9. The hull of a ship according to claim 8, wherein said at least one depression comprises two inwardly concave depressions located symmetrically with respect to said central propeller.

10. The hull of a ship according to claim 8, wherein the exterior surface of said ship's hull, below water, is a substantially smooth continuous surface.

11. The hull of a ship according to claim 8, further comprising at least a pair of auxiliary drive means for propelling said ship, said at least two auxiliary drive means being located so as to flank said central propeller.

12. The hull of a ship according to claim 1, wherein said at least one depression comprises two inwardly concave depressions located symmetrically with respect to said central propeller.

13. The hull of a ship according to claim 1, wherein there is at least one horizontal plane which intersects said displacement body at three separate and discrete individual areas, with a first of said three individual areas being located at substantially the longitudinal center line of said displacement body, and with the remaining two of said three individual areas being located on opposing sides of said first individual areas transverse to the longitudinal axis of said displacement body.

14. The hull of a ship according to claim 1, wherein the exterior surface of said ship's hull, below water, is a substantially smooth continuous surface.

15. The hull of a ship according to claim 1, further comprising at least a pair of auxiliary drive means for propelling said ship, said at least two auxiliary drive means being located so as to flank said central propeller.

* * * * *